United States Patent [19]

Griffith

[11] 4,290,461

[45] Sep. 22, 1981

[54] YARN FEED CONTROLLING DEVICE

[75] Inventor: John D. Griffith, Boldon, England

[73] Assignee: Bonas Machine Company Limited, Sunderland, England

[21] Appl. No.: 111,083

[22] Filed: Jan. 10, 1980

[30] Foreign Application Priority Data

Jan. 18, 1979 [GB] United Kingdom ..... 01855/79

[51] Int. Cl.[3] ..... D03D 47/34

[52] U.S. Cl. ..... 139/450; 139/452

[58] Field of Search ..... 139/429, 450, 452, 453; 242/147 R, 149, 156; 66/125, 146

[56] References Cited

U.S. PATENT DOCUMENTS

| | | | |
|---|---|---|---|
| 2,407,773 | 9/1946 | Fletcher | 139/450 |
| 2,912,185 | 11/1959 | Vossen | 139/450 |
| 3,224,467 | 12/1965 | Gagliardo | 139/452 |
| 4,086,942 | 5/1978 | Merisio | 139/450 |

FOREIGN PATENT DOCUMENTS

| | | | |
|---|---|---|---|
| 7511117 | 3/1977 | Netherlands | 139/429 |
| 218535 | 1/1968 | Sweden | 139/450 |

*Primary Examiner*—Henry Jaudon

*Attorney, Agent, or Firm*—James E. Nilles

[57] ABSTRACT

This invention provides a yarn feed and controlling device in which a resiliently mounted yarn controlling arm including a yarn guide eye is movable from a first position in which yarn can be continuously fed to a second position in which the yarn is restrained. The device includes a yarn restraining means associated with the yarn controlling arm which serves when the yarn is in the second position to restrain the yarn by applying a clamping force thereto.

9 Claims, 4 Drawing Figures

YARN FEED CONTROLLING DEVICE

BACKGROUND OF THE INVENTION

This invention concerns a yarn feed controlling device and more particularly, though not exclusively, a device for feeding and controlling weft yarn in a narrow fabric needleloom.

In a narrow fabric needleloom (hereinafter simply referred to as a "needleloom") weft yarn is generally supplied from a package and inserted in looped form through a warp shed by means of a weft inserting needle. It is known that, for the needle to function correctly, it must insert weft at a pre-determined tension and that a correct tension must be maintained when the weft inserting needle is being withdrawn from the weft shed prior to the insertion of the next loop of weft. Thus the tension in the weft yarn is not constant during a single loom cycle. For instance at one part of the loom cycle the weft yarn must be pulled back from the needle and temporarily stored. To achieve the correct weft yarn tension cycle the loom is usually provided with a weft yarn feeding device which includes a positive feed unit adapted to feed the weft yarn at a pre-determined and constant rate from the package and in addition there is provided a weft yarn storage and tensioning device incorporating one or more spring loaded weft yarn guide eyes.

A disadvantage of this type of feeding and tensioning means lies in the fact that the feeding device must be set exactly to match the amount of weft yarn take-up in the fabric and in addition the device cannot easily be used when it is desired to produce a patterned fabric including a number of wefts of different colour, since in such a fabric only that weft yarn which is actually being inserted is to be fed, the other or others being held in readiness for insertion in accordance with the pattern requirements. Somewhat similar disadvantages exist in looms other than needlelooms.

SUMMARY OF THE PRESENT INVENTION

It is an object of the present invention to provide a yarn feed and controlling device and method in which the disadvantages outlined above can be overcome.

Thus according to one aspect of the present invention a yarn feed and controlling device includes a resiliently mounted yarn controlling means including a yarn guide eye adapted in one position to enable yarn to be fed in un-restrained manner at the required tension and in another position to cause the yarn to be restrained, by a restraining means, whereby tension in the yarn upstream of the restraining means is reduced to cause discontinuation of the yarn supply.

Preferably the restraining means is in the form of a yarn clamping device.

In one form the yarn is located in the clamping device which latter comprises a fixed yarn guide element and a movable restraining element which latter is operated by movement of the yarn controlling means to move it from a position in which the yarn can move freely between the guide element and the restraining element to a position in which the restraining element holds the yarn against the guide element to clamp it and prevent yarn feed to the yarn controlling means. Alternatively the movement of the yarn controlling means causes the yarn to move under the restraining means, which latter is in the form of a resilient element mounted on a fixed member, the yarn thus becoming clamped between the restraining means and the fixed element.

Conveniently there is provided a yarn tensioner upstream of the yarn controlling means. Alternatively there may be provided a constant speed continuously driven yarn feed roller upstream of the yarn controlling means.

Preferably there is provided both a yarn tensioner and a constant speed yarn feed roller upstream of the yarn controlling means.

Preferably the yarn guide eye is formed at the free end of a yarn guide arm which has at its other end a torsion spring, the latter being carried by a support stud mounted at one side of a carrying plate which has, at its opposite side a yarn restraining means.

The invention will now be described further, by way of example only, with reference to the accompanying somewhat diagrammatic illustrations in which.

DESCRIPTION OF A PREFERRED EMBODIMENT

Figure 1:
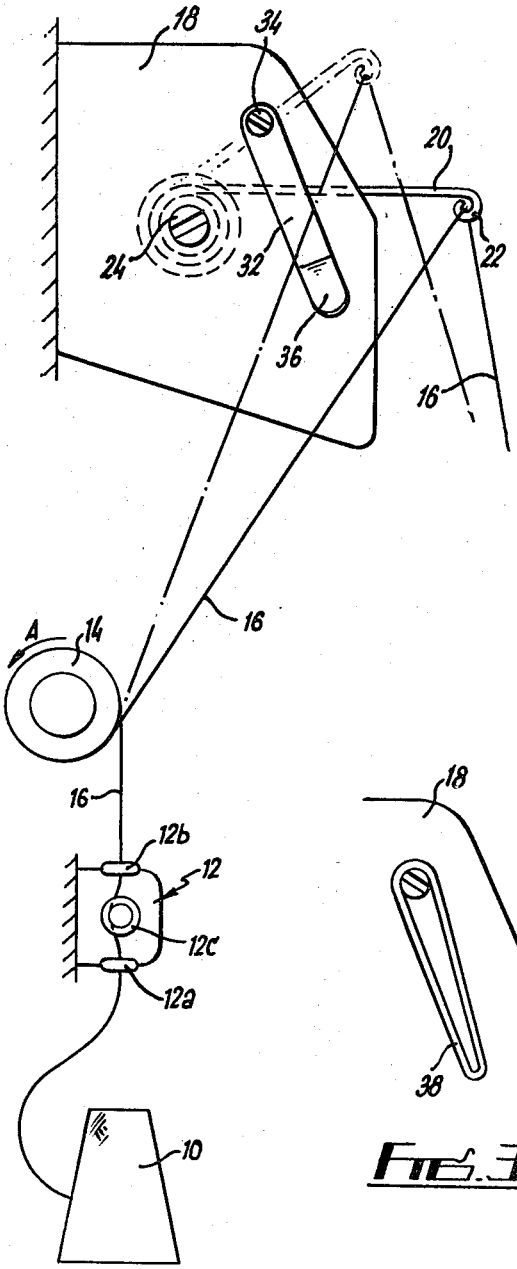
FIG. 1 is a side elevation of one form of device made in accordance with the invention.
Figure 2:
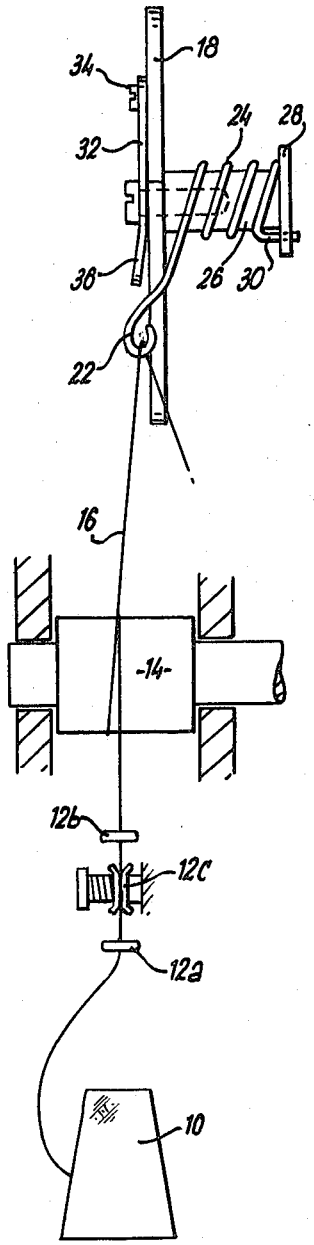
FIG. 2 is a front elevation of the device of FIG. 1.

Thus as shown in FIGS. 1 and 2 a device made in accordance with the invention comprises (upstream of a yarn package 10 and a yarn tension device 12 of known type) a rotatable drum 14 arranged to rotate in the direction of the arrow A to draw yarn 16 from the package 10 and through the tensioning device 12. For convenience we have illustrated a tensioning device 12 which consists of a pair of spaced-apart yarn guide eyes **12*a* and 12*b* and a pair of discs 12*c* one of which is spring loaded to bear against the other. The yarn 16 passes through the guide eyes 12*a* and 12*b* and between the discs 12*c***. Other types of yarn tensions can, of course, be utilized.

The yarn 16 is wrapped one or more times around the drum 14 and the latter is arranged to be continuously driven at constant speed. The surface of the drum 14 is smooth and formed of a hard wear resistant material.

Upstream of the drum 14 and mounted on a fixed plate 18 is a spring-loaded yarn guide arm 20 having at its free end a yarn guide eye 22 through which the yarn 16 passes. The yarn guide arm is conveniently made from spring steel rod and its end remote from the eye 22 is coiled to form a torsion spring 24 (see FIG. 2 in particular) which enwraps a stud 26 mounted on and projecting from one side of the plate 18. The free end of the stud 26 is provided with an external flange 28 and a notch or aperture in the flange 28 serves to receive and hold a tail 30 of the spring 24. Adjacent the eye 22 the arm 20 is cranked so that the eye 22 lies at the opposite side of the plate 18 to that from which the stud 26 projects. Mounted on the opposite side of the plate 18 to that from which the stud 26 projects is a yarn clamp plate 32 of resilient material such as spring steel.

One end of the clamp plate 32 is drilled to receive a fixing stud 34 by which it is attached to plate 18, the other end 36 of the clamp plate 32 being bent away from the plate 18 to provide a "lead-in" for the yarn 16 (as described below).

In use, assuming the device to be attached to a needleloom for the purpose of feeding and controlling weft yarn to a weft inserting needle the yarn package 10 serves as the weft supply. Thus, weft yarn 16 is fed through the guide eye 12*a*, between the discs 12*c* and through the guide eye 12*b*. This yarn is then wrapped around the drum 14, led through the guide eye 22 and to the weft inserting needle (not shown) of the loom. During weaving weft 16 is drawn off the package 10 and through the tensioning device 12 by the drum 14, which, as stated above rotates continuously at constant speed. During the weft insertion stroke of the weft inserting needle the yarn from the drum to the needle is tensioned thus holding the guide arm 20 in the lower position as illustrated, that is to say the yarn is held clear of the clamp plate 32. The tension in the yarn between the drum 14 and weft inserting needle is determined by the load produced by the torsion spring 24, and is independent of any tension variations in the yarn which occurs as a result of drawing the yarn off the package 10.

When yarn is no longer being pulled by the weft inserting needle, that is when the latter is being retracted from a warp shed, the drum 14 continues to rotate the feed yarn but the guide arm 20 can now move to the upper position illustrated thus causing the yarn 16 to be moved into position between the plate 18 and the clamp plate 32, the lead-in portion 34 of the clamp plate 32 facilitating yarn feed behind the clamp plate 32. The clamp plate 32 thus holds the yarn 16 and due to the fact that it is, at this point in time in the loom cycle, still being fed by the drum 14 tension in the length of yarn 16 between the drum 14 and clamp plate 32 reduces and the yarn becomes slack around the drum 14 which then ceases to draw yarn off the package 10.

In an alternative arrangement the drum 14 may be omitted in which case the yarn 16 passes directly from the tensioner 12 to the guide eye 22. The guide eye 22 and clamp 32 operate in the manner already described and when the guide eye 22 is in its lower position the yarn 16 is under sufficient tension to be pulled through tensioner 12. When the guide eye 22 moves to its upper position the yarn is held in clamp 32 and thus is prevented from further withdrawal as already described.

In a still further modification the tensioner 22 is omitted and yarn passes from the package 10 to the drum 14. As explained above the yarn is under sufficient tension to be pulled through the guide eye 22 when the latter is in its lower position and is held by the clamp plate 32 when the guide eye is in its upper position.

Figure 3:
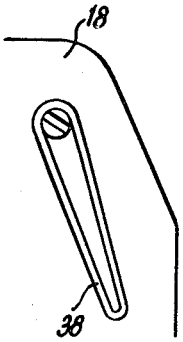
FIG. 3 is a side elevation showing a modification of part of the device shown in FIGS. 1 and 2.

The modification illustrated in FIG. 3 consists simply in replacing the clamp plate 32 by a clamp means 38 made from spring steel rod.

Figure 4:
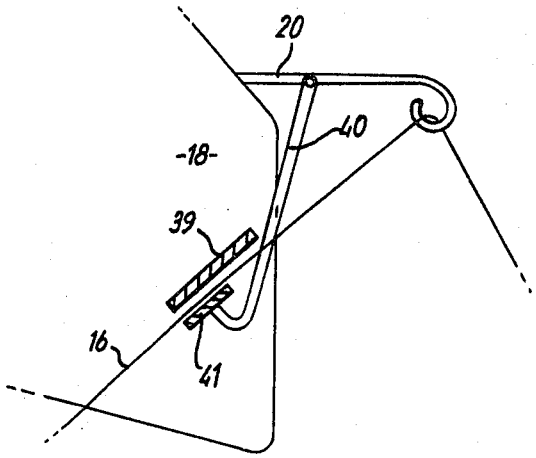
FIG. 4 is a side elevation partly in section showing a further modification.

In the modification illustrated diagrammatically in FIG. 4 the fixed plate 18 in provided with a yarn guide element 39 which extends from the plate 18 and lies above the path of movement of the yarn 16. The spring located yarn guide arm 20 is provided with a depending link 40 which is provided at its free end with a restraining element 41 which lies substantially parallel to the guide element 39 and is, when the yarn is being fed, spaced from the guide element 39 to allow the yarn 16 to pass freely between the guide element 39 and the restraining element 41. When the yarn guide arm 20 is allowed to move to its upper position, as described above, the element 40 is drawn towards the element 39 to hold the yarn 16 to cause the yarn to become stretched around the drum 14 which then ceases to draw yarn from the package 10.

It will be appreciated from the description set out above that one of the advantages of the device described lies in the fact that when it is not required to feed yarn to a weft inserting needle (as for example on the retraction thereof from the warp shed) such feed is discontinued and the yarn is held ready for the next insertion movement of the needle. As soon as the tension in the yarn increases and causes it to be released from the clamp the feed is recommenced.

Thus, while devices of the kinds referred to above can be used in a loom in which there is a single weft, it is also possible, by providing such devices for each different weft required when producing a patterned fabric in which there are several wefts, to use a single weft inserter, provided with a weft hook as opposed to a weft eye, and to feed and control each weft as required by the pattern in a simple and effective manner.

In addition the device possesses the advantage that yarn tension can be accurately set simply by adjusting the torsion spring 24. Such change in tension being achieved independently (and within wide limits) of the tension changes that occur in the yarn between the package and the yarn controlling device as the yarn is drawn from the package.

I claim:

1. A yarn feed apparatus for supplying yarn intermittently under a consistent tension, the apparatus including a yarn guide eye resiliently movably mounted on a base, a clamp means located upstream of the guide eye and being operated by the guide eye for intermittently trapping the yarn to prevent its movement through the apparatus, continuously rotatable yarn feed means upstream of the clamp means for positively feeding yarn to the guide eye only when yarn between the feed means and clamp means is under tension, the yarn guide eye being arranged to render the clamp means inoperative while yarn is being pulled from the apparatus and arranged to render the clamp means operative to grip the yarn to prevent further supply of yarn from the apparatus when yarn downstream of the guide eye is relaxed by a predetermined amount.

2. A yarn feed apparatus as claimed in claim 1 wherein the clamp means comprises a resilient element fixedly secured to the base so as to permit yarn to be trapped between itself and the base, the path of movement of the guide eye being arranged so that when yarn is being pulled from the apparatus the path of travel of the yarn is remote from the clamp means and when the yarn is relaxed downstream by said predetermined amount the guide eye moves due to its resilient mounting to draw the yarn in between the resilient element and the base to cause the yarn to be trapped therebetween.

3. A yarn feed apparatus as claimed in claim 2 wherein the yarn guide eye is mounted on one end of a yarn guide arm, the other end of the yarn guide arm having a torsion spring mounted on said base.

4. A yarn feed apparatus as claimed in claim 2 wherein the base includes a carrying plate to one side of which is attached the resilient element so as to permit yarn to be trapped between itself and the carrying plate, and wherein the yarn guide eye is mounted on one end of a yarn guide arm, the other end of the yarn guide arm having a torsion spring mounted on the opposite side of the carrying plate to said one side.

5. A yarn feed apparatus as claimed in claim 1 wherein the continuously rotating feed means comprises a constant speed continuously driven yarn feed roller.

6. A yarn feed apparatus as claimed in claim 5 including a yarn tensioner upstream of the clamp means.

7. A yarn feed apparatus as claimed in claim 1 wherein the clamp means comprises a fixed yarn restraining element and a movable restraining element, the movable restraining element being operated by movement of the yarn more freely between the fixed and movable restraining elements to a position in which the fixed and movable elements trap the yarn therebetween to prevent yarn feed to the guide eye.

8. A yarn feed apparatus as claimed in claim 7 wherein the continuously rotating feed means comprises a constant speed continuously driven yarn feed roller.

9. A yarn feed apparatus as claimed in claim 7 including a yarn tensioner upstream of the claim means.

* * * * *